US010982548B2

(12) United States Patent
Yagi et al.

(10) Patent No.: US 10,982,548 B2
(45) Date of Patent: Apr. 20, 2021

(54) IMPELLER, ROTARY MACHINE, METHOD FOR MANUFACTURING IMPELLER, AND METHOD FOR MANUFACTURING ROTARY MACHINE

(71) Applicant: MITSUBISHI HEAVY INDUSTRIES COMPRESSOR CORPORATION, Tokyo (JP)

(72) Inventors: Nobuyori Yagi, Tokyo (JP); Akihiko Morikawa, Hiroshima (JP); Shinichiro Tokuyama, Hiroshima (JP); Hiroki Takagi, Hiroshima (JP); Kenji Itagaki, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/478,664

(22) PCT Filed: Feb. 20, 2017

(86) PCT No.: PCT/JP2017/006146
§ 371 (c)(1),
(2) Date: Jul. 17, 2019

(87) PCT Pub. No.: WO2018/150576
PCT Pub. Date: Aug. 23, 2018

(65) Prior Publication Data

US 2019/0376391 A1 Dec. 12, 2019

(51) Int. Cl.
*F01D 5/14* (2006.01)

(52) U.S. Cl.
CPC ..... *F01D 5/14* (2013.01); *F05D 2230/40* (2013.01); *F05D 2230/90* (2013.01)

(58) Field of Classification Search
CPC ..... F01D 5/14; F04D 29/266; F04D 29/284; F04D 29/286; F04D 29/624; F04D 17/122; F05D 2230/40; F05D 2260/37
See application file for complete search history.

(56) References Cited

U.S. PATENT DOCUMENTS 2,392,858 A * 1/1946 McMahan ..... F04D 29/284 416/186 R
5,490,760 A 2/1996 Kotzur
(Continued)

FOREIGN PATENT DOCUMENTS

EP 3059454 A1 8/2016
JP H06-193585 A 7/1994
(Continued)

OTHER PUBLICATIONS

Haye, Industrial Solutions for Inductive Heating, Oct. 2013 (Year: 2013).*
(Continued)

*Primary Examiner* — David E Sosnowski
*Assistant Examiner* — Sabbir Hasan
(74) *Attorney, Agent, or Firm* — Osha Bergman Watanabe & Burton LLP

(57) ABSTRACT

An impeller includes a disk that has tubular first and second disk members, a blade that is integrally provided with the second disk member, and a cover that is integrally provided with the blade and covers the blade. The first disk member has a ring-shaped recessed portion therein. The second disk member has a ring-shaped engaging portion that is configured to engage with the first disk member by being inserted into the recessed portion. A first shrink-fitting portion is provided in a boundary portion between an outer circumferential surface of the engaging portion and an inner
(Continued)

circumferential surface of the recessed portion that comes into contact with the outer circumferential surface.

4 Claims, 10 Drawing Sheets

(56) References Cited

U.S. PATENT DOCUMENTS

| | | | | |
|---|---|---|---|---|
| 6,779,593 | B1 | 8/2004 | Hegde | |
| 9,664,055 | B2 * | 5/2017 | Yagi | F01D 5/30 |
| 10,443,605 | B2 * | 10/2019 | Yagi | F04D 29/624 |
| 2014/0050585 | A1 | 2/2014 | Kawanishi et al. | |
| 2014/0064975 | A1 | 3/2014 | Yagi et al. | |
| 2016/0290354 | A1 | 10/2016 | Yagi et al. | |

FOREIGN PATENT DOCUMENTS

| | | | |
|---|---|---|---|
| JP | H11-347811 | A | 12/1999 |
| JP | 2001-9626 | A | 1/2001 |
| JP | 2004-336031 | A | 11/2004 |
| JP | 2013-047479 | A | 3/2013 |
| JP | 2015-101967 | A | 6/2015 |
| JP | 5907723 | B2 | 4/2016 |

OTHER PUBLICATIONS

International Search Report and Written Opinion in corresponding International Application No. PCT/JP2017/006146, dated Mar. 28, 2017 (19 pages).

Decision to Grant in corresponding Japanese Application No. 2017-563266, dated Jan. 9, 2018 (5 pages).

* cited by examiner

IMPELLER, ROTARY MACHINE, METHOD FOR MANUFACTURING IMPELLER, AND METHOD FOR MANUFACTURING ROTARY MACHINE

TECHNICAL FIELD

The present invention relates to an impeller, a rotary machine, a method for manufacturing an impeller, and a method for manufacturing a rotary machine.

BACKGROUND ART

For example, a rotary machine used in an industrial compressor, a centrifugal chiller, a small-sized gas turbine, and the like, has an impeller having a disk fixed to a rotating body to which a plurality of blades are attached. The rotary machine configured as described above gives pressure energy and velocity energy to a gas by rotating the impeller.

As the impeller, a so-called closed impeller, in which a disk and a blade are integrated and a cover is integrally provided with the blade, is known (for example, refer to Patent Documents 1 to 3).

CITATION LIST

Patent Literature

[Patent Document 1] Japanese Unexamined Patent Application, First Publication No. 2015-10196

[Patent Document 2] Japanese Patent No. 5907723

[Patent Document 3] Japanese Unexamined Patent Application, First Publication No. 2013-47479

SUMMARY OF INVENTION

Technical Problem

There is a closed impeller combined by bonding a plurality of parts (a disk, a plurality of blades, and a cover) as the closed impeller. In a case of having such a bonded structure, it is difficult to combine the closed impeller such that connection positions of the plurality of parts are desired connection positions. For this reason, it is difficult to make a shape of a flow passage disposed between the disk and the cover a desired shape, and thus there is a possibility that the performance of the impeller decreases.

In order to solve such problems, integrating the disk, the plurality of blades, and the cover (making an impeller one piece) is considered. Although work of combining is unnecessary in this case, it is necessary to perform high-precision sharpening processing with the use of a tool with respect to a material to become a base material of the impeller.

In a case of making the impeller one piece, a part of the disk is disposed in a middle portion of the donut-shaped cover. Thus, when processing the base material of the impeller with the tool, this part of the disk becomes an obstacle at the time of tool insertion, and thereby there is a possibility that accurately processing the flow passage becomes difficult.

The present invention relates to an impeller, a rotary machine, a method for manufacturing an impeller, and a method for manufacturing a rotary machine, in which the accuracy of the shape of a flow passage to be formed between a second disk member and a cover can be enhanced after integrally configuring the second disk member, which is a separate body from a first disk member, a blade, and the cover.

Solution to Problem

According to a first aspect of the present invention, there is provided an impeller including a disk that has tubular first and second disk members, a blade that is integrally provided with the second disk member, and a cover that is integrally provided with the blade and defines a flow passage between the second disk member and the cover. The first disk member defines a part of the flow passage and has a ring-shaped recessed portion that has a central axis direction of the disk as a depth direction thereof. The second disk member has a ring-shaped engaging portion that is configured to engage with the first disk member by being inserted into the recessed portion. A first shrink-fitting portion is provided in a boundary portion between an outer circumferential surface of the engaging portion and an inner circumferential surface of the recessed portion, the inner circumferential surface coming into contact with the outer circumferential surface of the engaging portion.

By making the first disk member and the second disk member, which configure the disk, separate bodies as described above, it becomes easy to insert a tool, which is used when forming the flow passage to be disposed between the cover and the second disk member, into the cover and the second disk member. Therefore, the accuracy of the shape of the flow passage can be enhanced.

In addition, by integrating the second disk member, the blade, and the cover, work of combining the second disk member, the blade, and the cover becomes unnecessary. Therefore, a decrease in the accuracy of the shape of the flow passage attributable to assembling work can be limited.

Since the first shrink-fitting portion formed through shrink-fitting is included in the boundary portion between the outer circumferential surface of the engaging portion and the inner circumferential surface of the recessed portion as described above, it becomes possible to form the first shrink-fitting portion by heating an outer circumferential surface of a portion of the first disk member, which defines the recessed portion. Accordingly, since it is not necessary to directly heat the second disk member integrated with the blade when forming the first shrink-fitting portion, deformation of the blade attributable to the heating can be limited.

In the impeller according to a second aspect of the present invention, the engaging portion may have a plurality of step portions having different distances from a central axis of the disk to the outer circumferential surface of the engaging portion in the central axis direction of the disk. The shape of the recessed portion may be a shape that is configured to allow the recessed portion to be engaged with the plurality of step portions.

By configuring in such a manner, a plurality of outer circumferential surfaces of the engaging portion are provided. In a case where, out of the plurality of outer circumferential surfaces, a width of a certain outer circumferential surface in a central axis direction of the disk is the same as a width of another outer circumferential surface disposed on an outer side of the certain outer circumferential surface in the central axis direction of the disk, the area of another outer circumferential surface disposed on the outer side is wider.

Therefore, when a case where a desired area is obtained with the use of an engaging portion having only one outer circumferential surface is compared with a case where this desired area is obtained with the use of an engaging portion having a plurality of outer circumferential surfaces (engaging portion including the plurality of step portions), the engaging portion having the plurality of outer circumferential surfaces can be made to have a smaller length in the central axis direction of the disk than the engaging portion having only one outer circumferential surface.

In the impeller according to a third aspect of the present invention, the second disk member may have a portion abutting against the first disk member in the central axis direction of the disk and a portion forming a gap between the first disk member and the second disk member in the central axis direction of the disk.

By configuring in such a manner, the occurrence of fretting (in this case, surface damage that occurs when minute reciprocating slide has repeatedly acted on between the first disk member and the second disk main body, which come into contact with each other) can be limited by the gap.

In the impeller according to a fourth aspect of the present invention, the inner circumferential surface of the recessed portion may be an inclined surface that is inclined in a direction where an inner diameter of the recessed portion is narrowed as going from a bottom surface of the recessed portion to a second disk member side. The outer circumferential surface of the engaging portion may be an inclined surface that is configured to cause a thickness of the engaging portion to become smaller as being separated away from a tip surface of the engaging portion, which is disposed on a first disk member side, in the central axis direction of the disk.

By configuring in such a manner, it is possible to cause an anchoring effect in the first shrink-fitting portion (an effect that the engaging portion becomes unlikely to come out from the recessed portion in the central axis direction of the disk). Thus, the strength of connection between the first disk member and the second disk member can be improved.

In the impeller according to a fifth aspect of the present invention, a positioning key may be provided inside a portion where the first disk member has abutted against the second disk member in the central axis direction of the disk.

By providing the positioning key in the portion where the first disk main member has abutted against the second disk member in the central axis direction of the disk, positioning between the first disk member and the second disk member (positioning in a rotation direction of which a rotation axis is the central axis of the disk) can be easily performed.

According to a sixth aspect of the present invention, there is provided a rotary machine including the impeller and a rotating body which is configured to rotate about an axis matching a central axis of the disk as a rotation axis and to which the impeller is fixed. A second shrink-fitting portion may be provided in a boundary portion between an inner circumferential surface of a portion of the first disk member, in which the recessed portion is not formed, and an outer circumferential surface of the rotating body.

By configuring in such a manner, it is possible to provide the second shrink-fitting portion at a position separated away from the first shrink-fitting portion. Thus, the impeller can be fixed to the outer circumferential surface of the rotating body after limiting interference between the first shrink-fitting portion and the second shrink-fitting portion.

In the rotary machine according to a seventh aspect of the present invention, a shrink-fitting proportion of the second shrink-fitting portion may be lower than a shrink-fitting proportion of the first shrink-fitting portion.

By making the shrink-fitting proportion of the second shrink-fitting portion formed after the first shrink-fitting portion lower than the shrink-fitting proportion of the first shrink-fitting portion as described above, it can be limited that heat attributable to heating performed when forming the second shrink-fitting portion has an adverse effect on the first shrink-fitting portion.

According to an eighth aspect of the present invention, there is provided a method for manufacturing an impeller including a step of forming a tubular first disk member having a ring-shaped recessed portion therein, a step of forming a structure in which a second disk member having a ring-shaped engaging portion that is configured to engage with the first disk member by being inserted into the recessed portion, a blade provided on the second disk member, and a cover that is provided on the blade, covers the blade, and defines a flow passage between the second disk member and the cover are integrated, and a first shrink-fitting step of shrink-fitting a boundary portion between an outer circumferential surface of the engaging portion and an inner circumferential surface of the recessed portion by inserting the engaging portion configuring the structure into the recessed portion and heating the first disk member from an outer circumferential surface side of the first disk member.

By performing the step of forming the first disk member and the step of integrally forming the second disk member, the blade provided on the second disk member, and the cover that is provided on the blade and covers the blade as separate steps as described above, it becomes possible to easily process the flow passage to be formed between the second disk member and the cover with the use of a tool. Therefore, the accuracy of the shape of the flow passage can be enhanced.

By heating the first disk member from the outer circumferential surface side of the first disk member and shrink-fitting the outer circumferential surface of the engaging portion to the inner circumferential surface of the recessed portion, it becomes not necessary to directly heat the second disk member integrated with the blade when forming the first shrink-fitting portion. Thus, deformation of the blade attributable to the heating when forming the first shrink-fitting portion can be limited.

According to a ninth aspect of the present invention, a method for manufacturing a rotary machine may include a step of preparing an impeller manufactured through the method for manufacturing an impeller according to the eighth aspect and a second shrink-fitting step of shrink-fitting a boundary portion between an inner circumferential surface of a portion of the first disk member, in which the recessed portion is not formed, and an outer circumferential surface of a rotating body by heating the first disk member from an outer circumferential surface side of the portion in which the recessed portion is not formed in a state where the rotating body is inserted in the impeller.

Accordingly, since it becomes not necessary to directly heat the second disk member integrated with the blade by heating the first disk main member from the outer circumferential surface side of the portion of the first disk member, in which recessed portion is not formed, in a state where the rotating body is inserted in the impeller as described above, deformation of the blade attributable to the heating can be limited.

In the method for manufacturing a rotary machine according to a tenth aspect of the present invention, a heating temperature of the first disk member in the second shrink-fitting step may be lower than a heating temperature of the first disk member in the first shrink-fitting step.

By making the heating temperature when forming the second shrink-fitting portion formed after the first shrink-fitting portion lower than the heating temperature when forming the first shrink-fitting portion as described above, it can be limited that heating when forming the second shrink-fitting portion has an adverse effect on the first shrink-fitting portion.

Advantageous Effects of Invention

According to the present invention, the accuracy of the shape of the flow passage of the impeller can be enhanced after integrally configuring the second disk member, which is a separate body from the first disk member, the blade, and the cover.

DESCRIPTION OF EMBODIMENTS

First Embodiment

Figure 1:
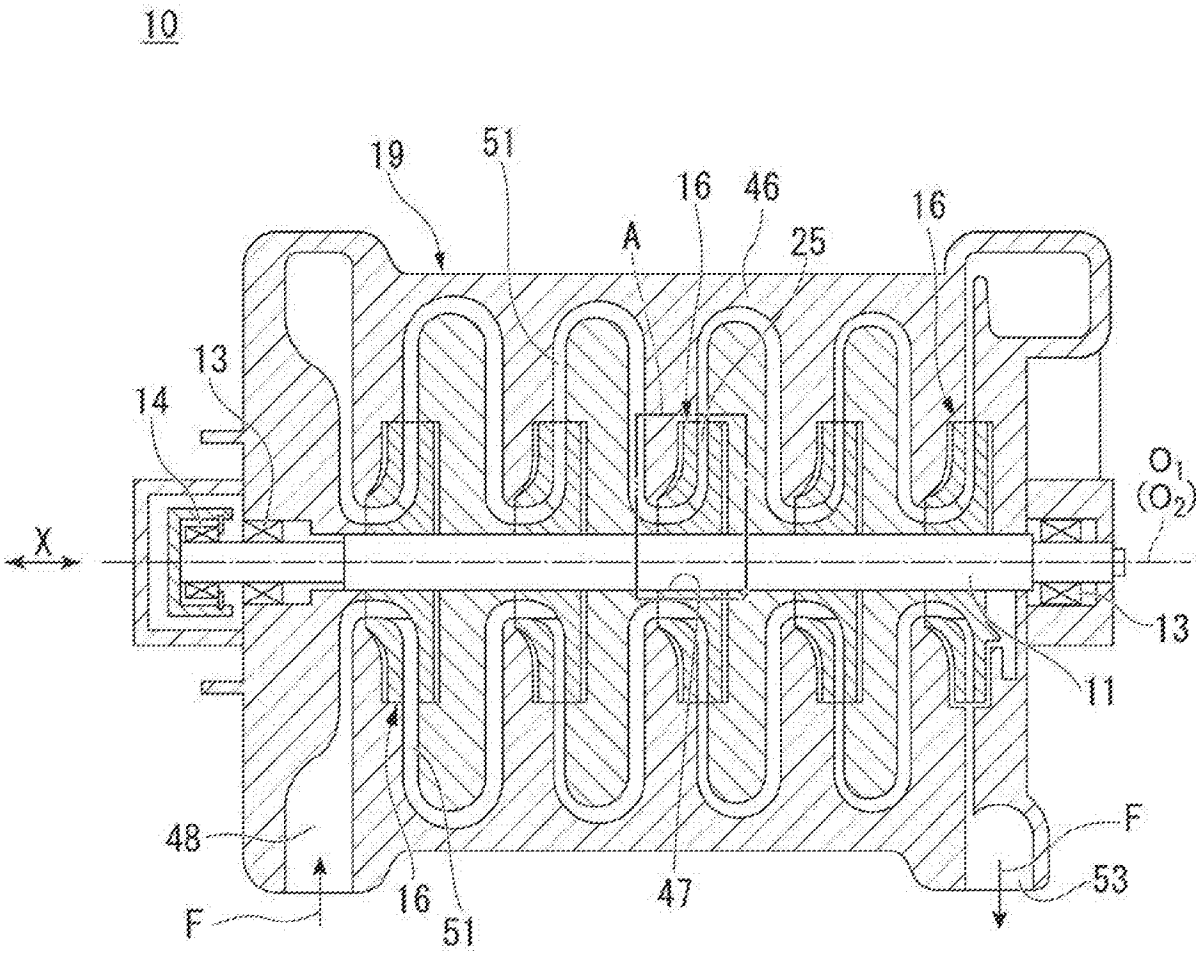
FIG. 1 is a sectional view schematically showing a simplified configuration of a rotary machine according to a first embodiment of the present invention.

FIG. 1 is a sectional view schematically showing a simplified configuration of a rotary machine according to a first embodiment of the present invention. In FIG. 1, A indicates a region (hereinafter, referred to as a "region A"), F indicates a working fluid (hereinafter, referred to as a "working fluid F"), $O_1$ indicates a central axis of a disk 21 (hereinafter, referred to as a "central axis $O_1$"), $O_2$ indicates an axis of a rotating body 11 (hereinafter, referred to as an "axis $O_2$"), and an X-direction indicates a central axis $O_1$ direction of the disk 21. The central axis $O_1$ and the axis $O_2$ extend in the same direction (X-direction) and match each other.

FIG. 1 shows a centrifugal compressor as an example of a rotary machine 10. Since it is difficult to show details of impellers 16 shown in FIG. 2, which are to be described later, FIG. 1 shows the impellers 16 in a simplified state.

In FIG. 1, the rotary machine 10 of the first embodiment has the rotating body 11, journal bearings 13, a thrust bearing 14, the plurality of impellers 16, a second shrink-fitting portion 18, and a casing 19.

The rotating body 11 has a cylindrical shape and extends in the X-direction. The rotating body 11 is rotated about the axis $O_2$ by a source of power such as an electric motor. The impellers 16 accommodated in the casing 19 are fitted onto the rotating body 11. Accordingly, the rotating body 11 rotates about the axis $O_2$ along with the impellers 16.

The rotating body 11 is rotatably supported by the journal bearings 13 and the thrust bearing 14 with respect to the casing 19.

The journal bearings 13 are provided on both end portions of the rotating body 11 in the X-direction. The journal bearings 13 are disposed to oppose an outer circumferential surface of the rotating body 11.

The thrust bearing 14 is provided on an end of the rotating body 11 positioned on a suction port 48 side to be described later.

The plurality of impellers 16 are disposed at desired intervals in the X-direction. The plurality of impellers 16 are integrally fixed to the rotating body 11, and integrally rotate with the rotating body 11 along with the rotation of the rotating body 11. In a state of being fixed to the rotating body 11, the plurality of impellers 16 are accommodated inside the casing 19.

Figure 2:
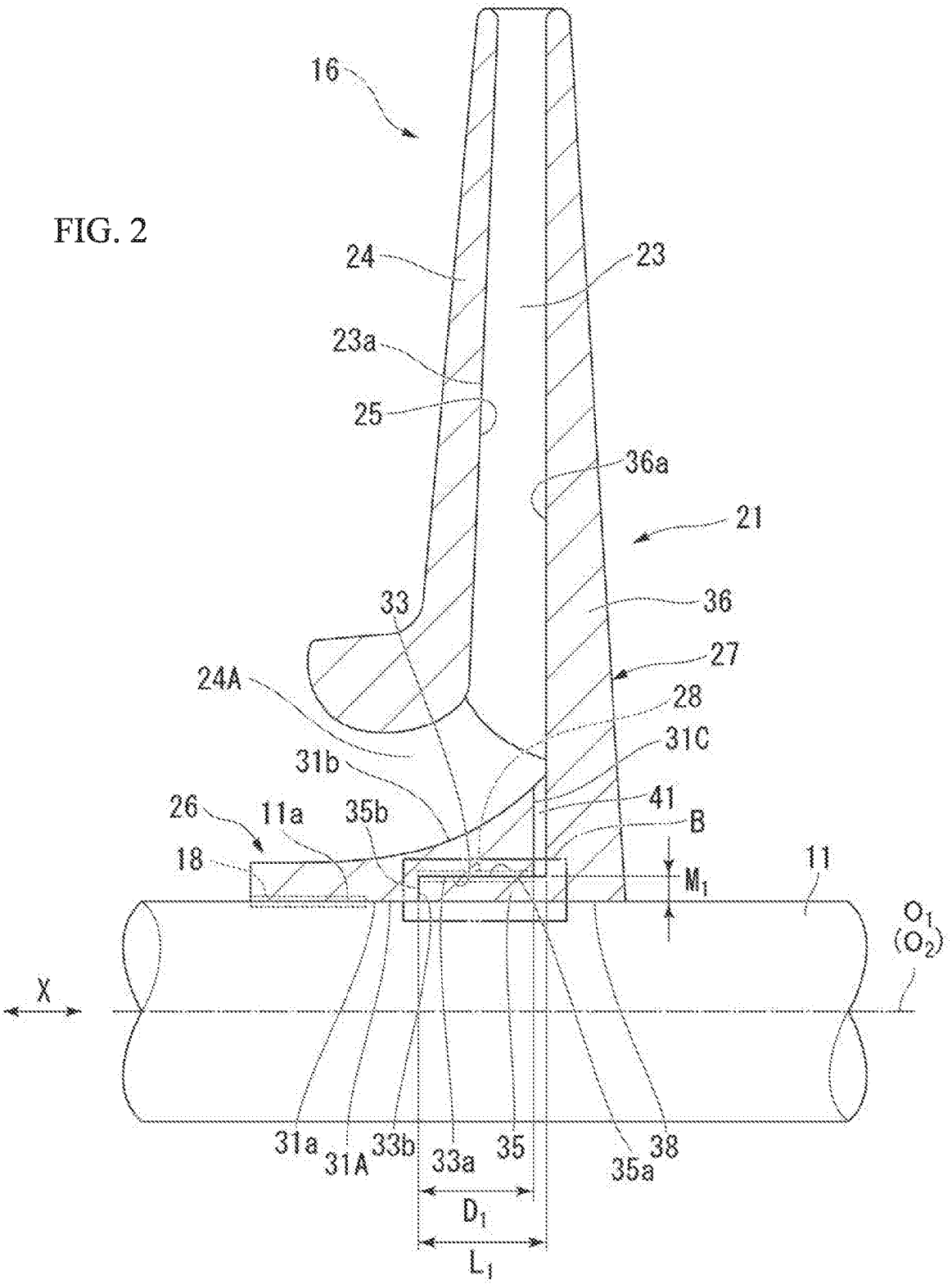
FIG. 2 is a sectional view of an enlarged portion surrounded by a region A, out of structures shown in FIG. 1.

FIG. 2 is a sectional view of an enlarged portion surrounded by the region A, out of structures shown in FIG. 1. In FIG. 2, the same configuration portions as the structures shown in FIG. 1 will be assigned with the same reference signs. B shown in FIG. 2 indicates a region where a recessed portion 33 and an engaging portion 35 are inserted (hereinafter, referred to as a "region B").

Figure 3:
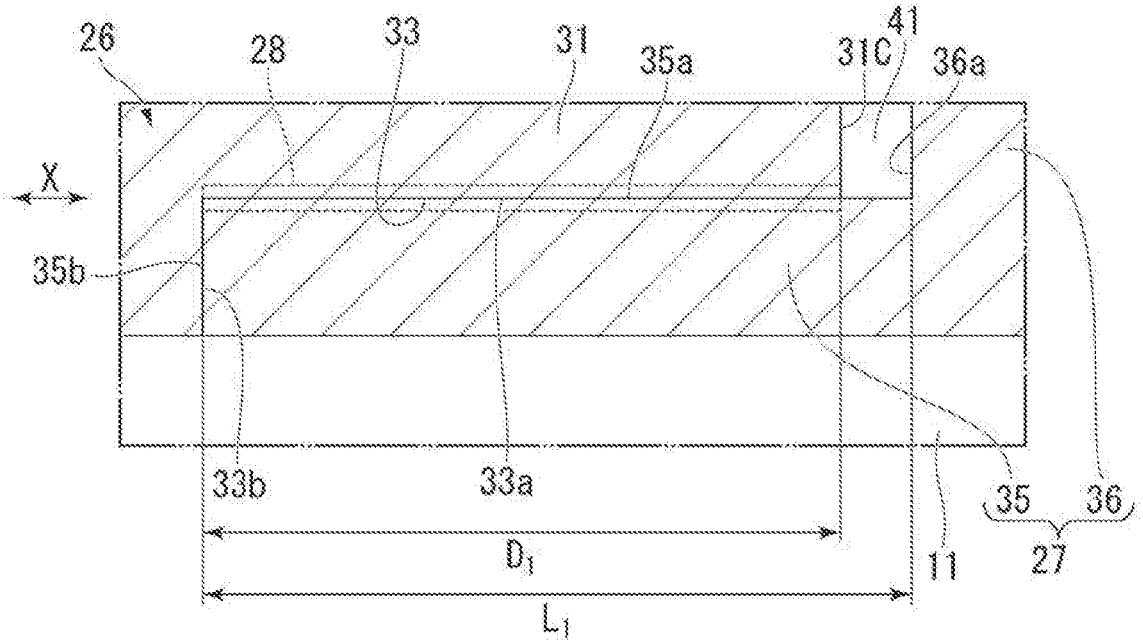
FIG. 3 is a sectional view of an enlarged portion surrounded by a region B, out of structures shown in FIG. 2.

FIG. 3 is a sectional view of an enlarged portion surrounded by the region B, out of structures shown in FIG. 2. In FIG. 3, the same configuration portions as the structures shown in FIG. 2 will be assigned with the same reference signs.

Figure 4:
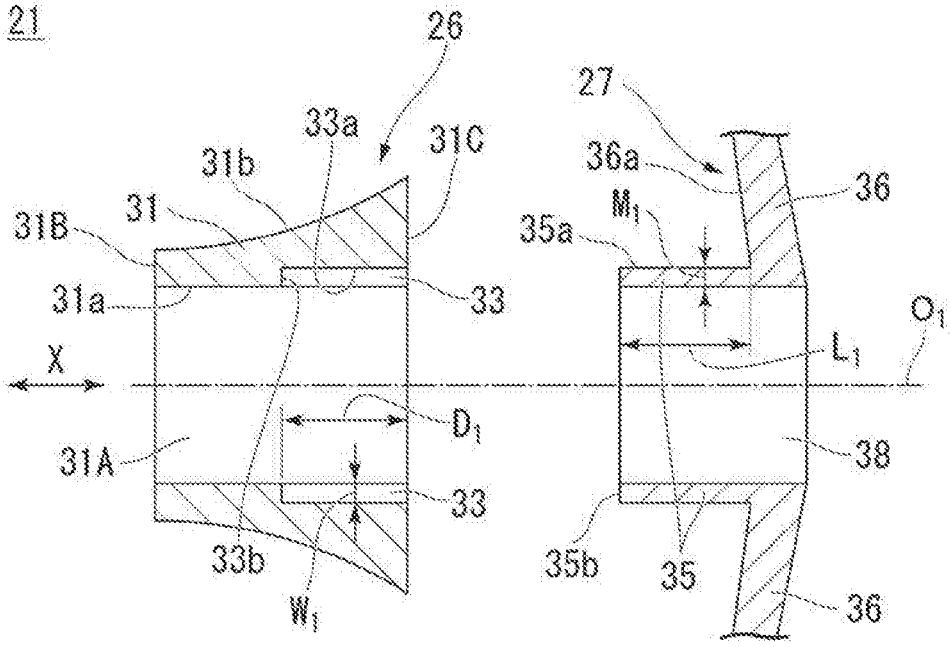
FIG. 4 is a sectional view showing disassembled first and second disk members before shrink-fitting.

FIG. 4 is a sectional view showing disassembled first and second disk members before shrink-fitting. In FIG. 4, the same configuration portions as the structures shown in FIGS. 1 to 3 will be assigned with the same reference signs.

Herein, a configuration of each of the impellers 16 will be described with reference to FIGS. 1 to 4. Each of the impellers 16 is a closed impeller, and has the disk 21, blades 23, a cover 24, and a flow passage 25 in which the working fluid F flows.

The disk 21 has a first disk member 26, a second disk member 27, and a first shrink-fitting portion 28.

The first disk member 26 has a tubular shape. The first disk member 26 has a first disk main body 31 and the recessed portion 33. The first disk main body 31 is a tubular member. The first disk main body 31 has a through-hole 31A into which the rotating body 11 is inserted, an inner circumferential surface 31*a* that defines the through-hole 31A, and an outer circumferential surface 31*b*.

The outer circumferential surface 31*b* of the first disk main body 31 defines a part of the flow passage 25 between the cover 24 and the outer circumferential surface.

The first disk main body 31 has a shape of which an outer diameter increases as going from one end 31B (an end positioned on the suction port 48 side) to the other end 31C (an end which is on a side of opposing the second disk member 27 and is positioned on a discharge port 53 side) of the first disk main body 31. The outer circumferential surface 31*b* is a curved inclined surface.

The recessed portion 33 is formed by cutting the other end 31C of the first disk main body 31, which is to be described later, in the X-direction into a ring shape. Accordingly, the shape of the recessed portion 33 becomes a ring shape. In addition, the recessed portion 33 has the X-direction as a depth direction thereof.

The recessed portion 33 has an inner circumferential surface 33*a* parallel to the outer circumferential surface 11*a* of the rotating body 11 and a bottom surface 33*b* orthogonal to the X-direction. The inner circumferential surface 33*a* is a surface that is not inclined in the X-direction (horizontal surface). The bottom surface 33*b* and the inner circumferential surface 33*a* are disposed in the first disk main body 31.

A portion of the inner circumferential surface 31*a* of the first disk main body 31, in which the recessed portion 33 is not formed, is shrink-fitted to the outer circumferential surface 11*a* of the rotating body 11. Accordingly, the first disk main body 31 is fixed to the rotating body 11.

The second disk member 27 has a tubular shape. The second disk member 27 is a separate body from the first disk member 26, and is integrated with the plurality of impeller 16 and the casing 19.

By making the first disk member 26, which is fixed to the rotating body 11, and the second disk member 27 separate bodies as described above, it becomes easy to insert a tool (not shown), which is used when forming the flow passage 25 to be disposed between the cover 24 and the second disk member 27, into the cover 24 and the second disk member 27. Therefore, the accuracy of the shape of the flow passage 25 can be enhanced.

In addition, by integrating the second disk member 27, the blades 23, and the cover 24, work of combining the second disk member 27, the blades 23, and the cover 24 becomes unnecessary. Therefore, a decrease in the accuracy of the shape of the flow passage attributable to assembling work can be limited.

The second disk member 27 has the engaging portion 35, a second disk main body 36, and a through-hole 38.

The engaging portion 35 is a ring-shaped member which is integrated with the second disk main body 36, and extends in the X-direction. The engaging portion 35 has an outer circumferential surface 35*a* that comes into contact with the inner circumferential surface 33*a* of the recessed portion 33 when inserted in the recessed portion 33. The outer circumferential surface 35*a* is a surface that is not inclined in the X-direction (surface parallel to the X-direction).

A thickness $M_1$ of the engaging portion 35 in a radial direction of the disk 21 (direction orthogonal to the X-direction) is configured to be a thickness uniform in the X-direction and to be substantially equal to a width $W_1$ of the recessed portion 33 in the radial direction of the disk 21.

A length $L_1$ of the engaging portion 35 in the X-direction is configured to be larger than a value of a depth $D_1$ of the recessed portion in the X-direction. By configuring as described above, it becomes possible to form a gap 41 between the other end 31C of the first disk main body 31 (the first disk member 26) and the second disk main body 36 in a state where a tip surface 35*b* of the engaging portion 35 has abutted against the bottom surface 33*b* of the recessed portion 33.

By forming the gap 41 between the first disk member 26 and the second disk main body 36 in the X-direction as described above, the occurrence of fretting (in this case, surface damage that occurs when minute reciprocating slide has repeatedly acted on between the first disk member 26 and the second disk member 27, which come into contact with each other) can be limited.

The rotating body 11 is inserted in the engaging portion 35 in a state where the second disk member 27 and the first disk member 26 are shrink-fitted to each other.

The second disk main body 36 is provided on a rear end of the engaging portion 35, which is positioned on an opposite side to the tip surface 35*b*. The second disk main body 36 is integrally configured with the engaging portion 35. The second disk main body 36 is erected from the outer circumferential surface 11*a* of the rotating body 11 in a radial direction of the rotating body 11. The second disk main body 36 is a donut-shaped plate member.

The second disk main body 36 is configured such that a thickness in the X-direction becomes smaller as being separated away from the outer circumferential surface 11*a* of the rotating body 11. The second disk main body 36 has a surface 36*a* that defines the gap 41. The surface 36*a* opposes the other end 31C of the first disk main body 31 via the gap 41.

The through-hole 38 is provided in the engaging portion 35 and the second disk main body 36. The rotating body 11 is inserted into the through-hole 38.

The first shrink-fitting portion 28 is provided in a boundary portion between the inner circumferential surface 33*a* of the recessed portion 33 and the outer circumferential surface 35*a* of the engaging portion 35. The first shrink-fitting portion 28 is a portion formed by heating the outer circumferential surface 31*b* of the first disk main body 31 that defines the recessed portion 33 having an inner diameter smaller than an outer diameter of the engaging portion 35 to increase the inner diameter of the recessed portion 33 by means of thermal expansion and fitting the engaging portion 35 into the recessed portion 33 of which the inner diameter has increased.

That is, the first shrink-fitting portion 28 refers to a portion made by bonding a portion of the first disk main body 31, which defines the inner circumferential surface 33*a* of the recessed portion 33, to a portion of the engaging portion 35, which defines the outer circumferential surface 35*a*, through shrink-fitting.

By having the first shrink-fitting portion 28 disposed in the boundary portion between the outer circumferential surface 35*a* of the engaging portion 35 and the inner circumferential surface 33*a* of the recessed portion 33 as described above, it becomes possible to heat the outer circumferential surface 31*b* of the first disk main body 31 (an outer circumferential surface of a portion of the first disk member 26, which defines the recessed portion 33) and to form the first shrink-fitting portion 28. Accordingly, since it is not necessary to directly heat the second disk member 27 integrated with the blades 23 when forming the first shrink-fitting portion 28, deformation of the blades 23 attributable to the heating can be limited.

The plurality of blades 23 are provided on a surface of the surface 36*a* of the second disk main body 36, which is separated away from the gap 41. The plurality of blades 23 are integrally configured with the second disk member 27. The plurality of blades 23 are radially disposed around the first disk member 26 in a circumferential direction of the second disk main body 36.

The plurality of blades 23 protrude in a direction orthogonal to the surface 36*a* of the second disk main body 36, and extend in a direction toward a tip of the second disk main body 36. Each of the plurality of blades 23 is configured such that a protruding amount (in other words, a thickness) thereof decreases as going from the first disk member 26 to the tip of the second disk main body 36.

Each of the plurality of blades 23 has a surface 23*a* disposed on an opposite side to a surface comes into contact with the surface 36*a* of the second disk main body 36.

The cover 24 is a donut-shaped member, and has a through-hole 24A in a middle portion. The cover 24 is provided on the surface 23*a* of each of the plurality of blades 23. In this state, the through-hole 24A exposes the first disk member 26. The cover 24 covers the plurality of blades 23.

By the first disk member 26 being disposed, a part of the through-hole 24A configures a part of the flow passage 25.

The flow passage 25 is provided between the cover 24 and the second disk member 27. The flow passage 25 is defined by the blades 23, the cover 24, and the second disk member 27.

The second shrink-fitting portion 18 is disposed in a boundary portion between the inner circumferential surface 31*a* of the first disk main body 31 (an inner circumferential surface of a portion of the first disk main body 31, in which the recessed portion 33 is not formed) and the outer circumferential surface 11*a* of the rotating body 11. The second shrink-fitting portion 18 fixes the first disk member 26 to the rotating body 11.

The second shrink-fitting portion 18 is formed by heating (in other words, shrink-fitting) the outer circumferential surface 31*b* of the first disk main body 31 (an outer circumferential surface of a portion of the first disk main body 31, in which the recessed portion 33 is not formed). The second shrink-fitting portion 18 refers to a portion made by bonding a portion of the first disk main body 31, which defines the outer circumferential surface 31*b* of a portion of the first disk main body 31 in which the recessed portion 33 is not formed, to the outer circumferential surface 11*a*, which is a part of the rotating body 11, through shrink-fitting.

For example, a shrink-fitting proportion of the second shrink-fitting portion 18 may be lower than a shrink-fitting proportion of the first shrink-fitting portion 28.

By making the shrink-fitting proportion of the second shrink-fitting portion 18 formed after the first shrink-fitting portion 28 lower than the shrink-fitting proportion of the first shrink-fitting portion 28 as described above, it can be limited that heat attributable to heating performed when forming the second shrink-fitting portion 18 has an adverse effect on the first shrink-fitting portion 28.

In FIG. 1, the casing 19 has a casing main body 46, a penetrated portion 47, a suction port 48, a flow passage 51, and a discharge port 53. The casing main body 46 accommodates the rotating body 11, the journal bearings 13, and the plurality of impellers 16.

The penetrated portion 47 is a hole extending in the X-direction, and the rotating body 11 is inserted therein. The suction port 48 is provided on a side of one end portion of the casing main body 46. The suction port 48 functions as a suction port for sucking the working fluid F, which is a gas, into the casing 19 from the outside.

The flow passage 51 is provided inside the casing main body 46. The flow passage 51 has one end connected to the suction port 48 and the other end connected to the discharge port 53. In addition, the flow passage 51 is also connected to the flow passage 25 of each of the impellers 16. Accordingly, the flow passage 51 is configured to allow the working fluid F to be supplied into the flow passage of each of the impellers 16.

The discharge port 53 is provided on a side of the other end portion of the casing main body 46. The discharge port 53 functions as a discharge port for discharging the working fluid F, which flows in the casing 19, to the outside.

In the impeller 16 according to the first embodiment, by making the first disk member 26, which is fixed to the rotating body 11, and the second disk member 27 separate bodies as described above, it becomes easy to insert the tool (not shown), which is used when forming the flow passage 25 to be disposed between the cover 24 and the second disk member 27, into the cover 24 and the second disk member 27. Therefore, the accuracy of the shape of the flow passage 25 can be enhanced.

In addition, by integrating the second disk member 27, the blades 23, and the cover 24, work of combining the second disk member 27, the blades 23, and the cover 24 becomes unnecessary. Therefore, a decrease in the accuracy of the shape of the flow passage attributable to assembling work can be limited.

By having the first shrink-fitting portion 28 disposed in the boundary portion between the outer circumferential surface 35*a* of the engaging portion 35 and the inner circumferential surface 33*a* of the recessed portion 33 as described above, it becomes possible to heat the outer circumferential surface 31*b* of the first disk main body 31 (the outer circumferential surface of the portion of the first disk member 26, which defines the recessed portion 33) and to form the first shrink-fitting portion 28. Accordingly, since it is not necessary to directly heat the second disk member 27 integrated with the blades 23 when forming the first shrink-fitting portion 28, deformation of the blades 23 attributable to the heating can be limited.

A position at which the disk 21 is divided into two portions (in other words, a dividing position between the first disk member 26 and the second disk member 27) may be on a through-hole 31A side of a region where the blades 23 are formed, and the dividing position between the first disk member 26 and the second disk member 27 is not limited to the dividing position shown in FIGS. 2 and 3.

In addition, although a case where the bottom surface 33*b* of the recessed portion 33 abuts against the tip surface 35*b* of the engaging portion 35 such that the gap 41 is provided between the other end 31C of the first disk main body 31 and the surface 36*a* of the second disk main body 36 is given as an example and is shown in FIGS. 2 and 3, for example, the other end 31C of the first disk main body 31 may be brought into contact with the surface 36*a* of the second disk main body 36 such that the gap 41 is provided between the bottom surface 33*b* of the recessed portion 33 and the tip surface 35*b* of the engaging portion 35. Also in this case, fretting can be limited.

In the rotary machine 10 of the first embodiment, it is possible to provide the second shrink-fitting portion 18 at a position separated away from the first shrink-fitting portion 28. Thus, the impellers 16 can be fixed to the outer circumferential surface 11*a* of the rotating body 11 after limiting interference between the first shrink-fitting portion 28 and the second shrink-fitting portion 18. In addition, since the rotary machine 10 of the first embodiment includes the impellers 16 described above, the same effects as the impellers 16 can be obtained.

Figure 5:
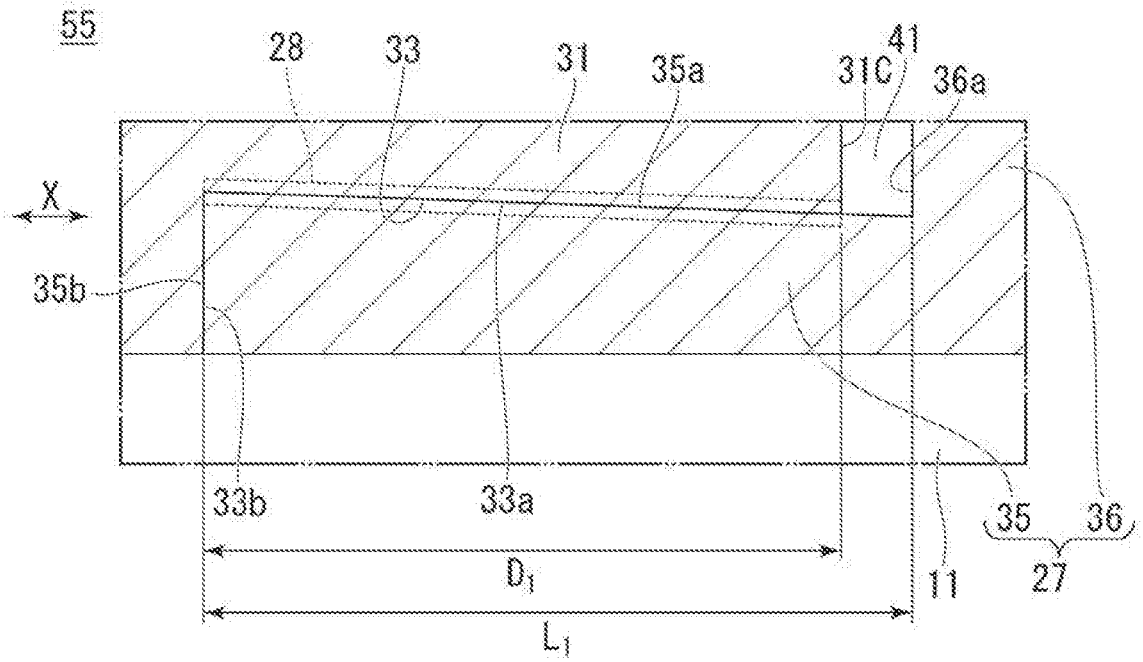
FIG. 5 is a sectional view of enlarged main portions of an impeller according to a modification example of the first embodiment of the present invention.

FIG. 5 is a sectional view of enlarged main portions of an impeller according to a modification example of the first embodiment of the present invention. In FIG. 5, the same configuration portions as the structures shown in FIG. 3 will be assigned with the same reference signs.

In FIG. 5, an impeller 55 of the modification example of the first embodiment is configured the same as the impeller 16 of the first embodiment described above except that the inner circumferential surface 33*a* of the recessed portion 33 and the outer circumferential surface 35*a* of the engaging portion 35 are inclined surfaces which are inclined in the X-direction.

The inner circumferential surface 33*a* of the recessed portion 33 is an inclined surface, which is inclined in a direction where the inner diameter of the recessed portion 33 is narrowed (decreases) (a surface which is inclined in the X-direction) as going from the bottom surface 33*b* to the second disk main body 36 (a second disk member 27 side).

The outer circumferential surface 35*a* of the engaging portion 35 is in contact with the inner circumferential surface 33*a* of the recessed portion 33, and is an inclined surface that causes a thickness of the engaging portion 35 to become smaller (lower surface inclined in the central axis $O_1$ direction of the disk 21) as going from the tip surface 35*b* of the engaging portion 35 disposed on a first disk member 26 side to a second disk main body 36 side (as being separated away in the X-direction).

In the impeller 55 according to the modification example of the first embodiment, it is possible to cause an anchoring effect in the first shrink-fitting portion 28 (an effect that the engaging portion 35 becomes unlikely to come out from the recessed portion 33 in the X-direction) by making the inner circumferential surface 33*a* of the recessed portion 33 an inclined surface inclined in a direction where the inner diameter of the recessed portion 33 is narrowed as going from the bottom surface 33*b* to the second disk main body 36, and making the outer circumferential surface 35*a* of the engaging portion 35 an inclined surface that causes the thickness of the engaging portion 35 to become smaller as going from the tip surface 35*b* of the engaging portion 35 disposed on the first disk member 26 side to the second disk main body 36 side. Thus, the strength of connection between the first disk member 26 and the second disk member 27 can be improved.

Although a case where the gap 41 is provided between the other end 31C of the first disk main body 31 and the surface 36*a* of the second disk main body 36 in each of the impellers 16 and 55 described above is given and described as an example, the gap 41 may be provided between the bottom surface 33*b* and the tip surface 35*b* by abutting the other end 31C of the first disk main body 31 against the surface 36*a* of the second disk main body 36 such that the bottom surface 33*b* of the recessed portion 33 and the tip surface 35*b* of the engaging portion 35 are separated away from each other in the X-direction. Also in a case where such a configuration is adopted, fretting can be limited.

Figure 6:
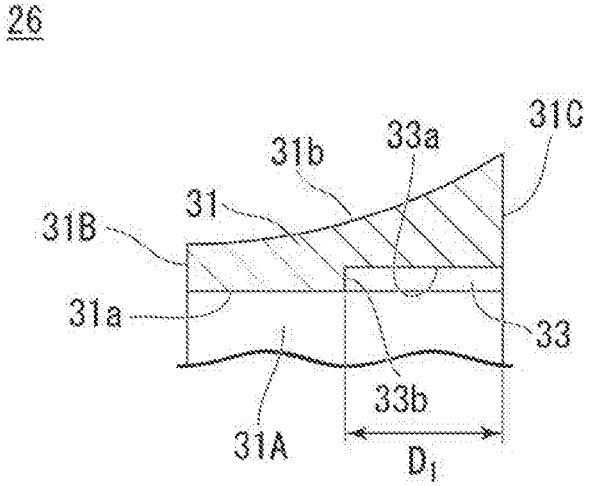
FIG. 6 is a (first) sectional view showing a method for manufacturing an impeller according to the first embodiment of the present invention.
Figure 7:
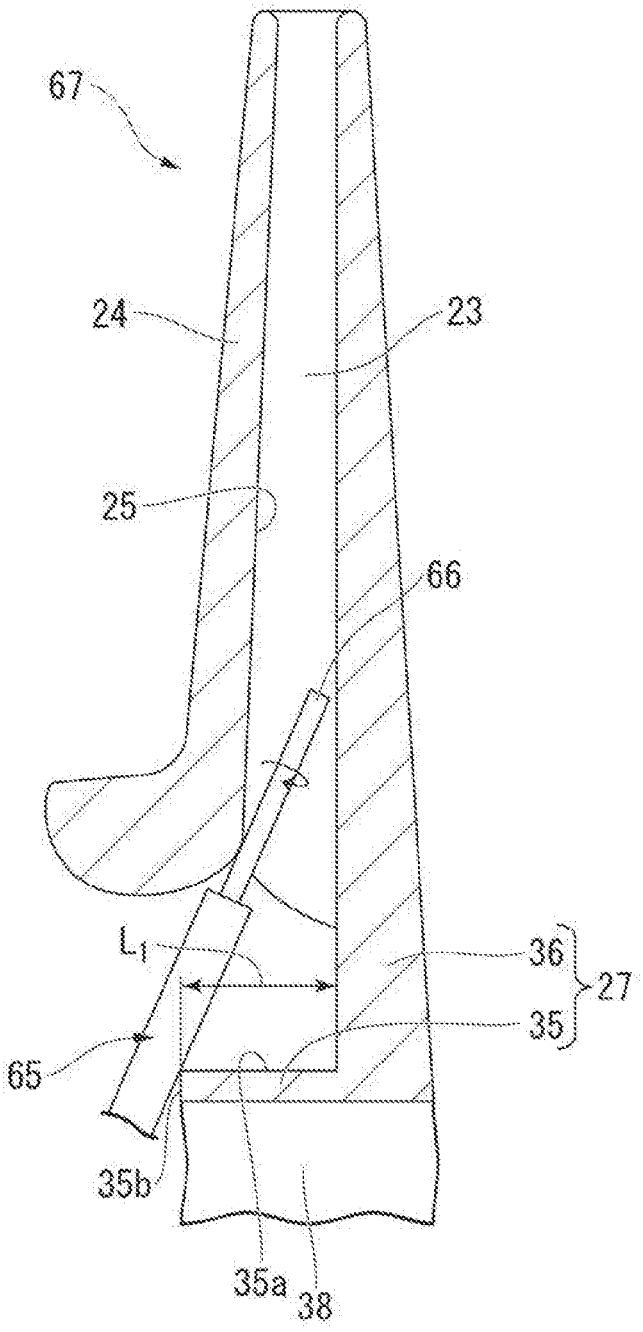
FIG. 7 is a (second) sectional view showing the method for manufacturing an impeller according to the first embodiment of the present invention.
Figure 8:
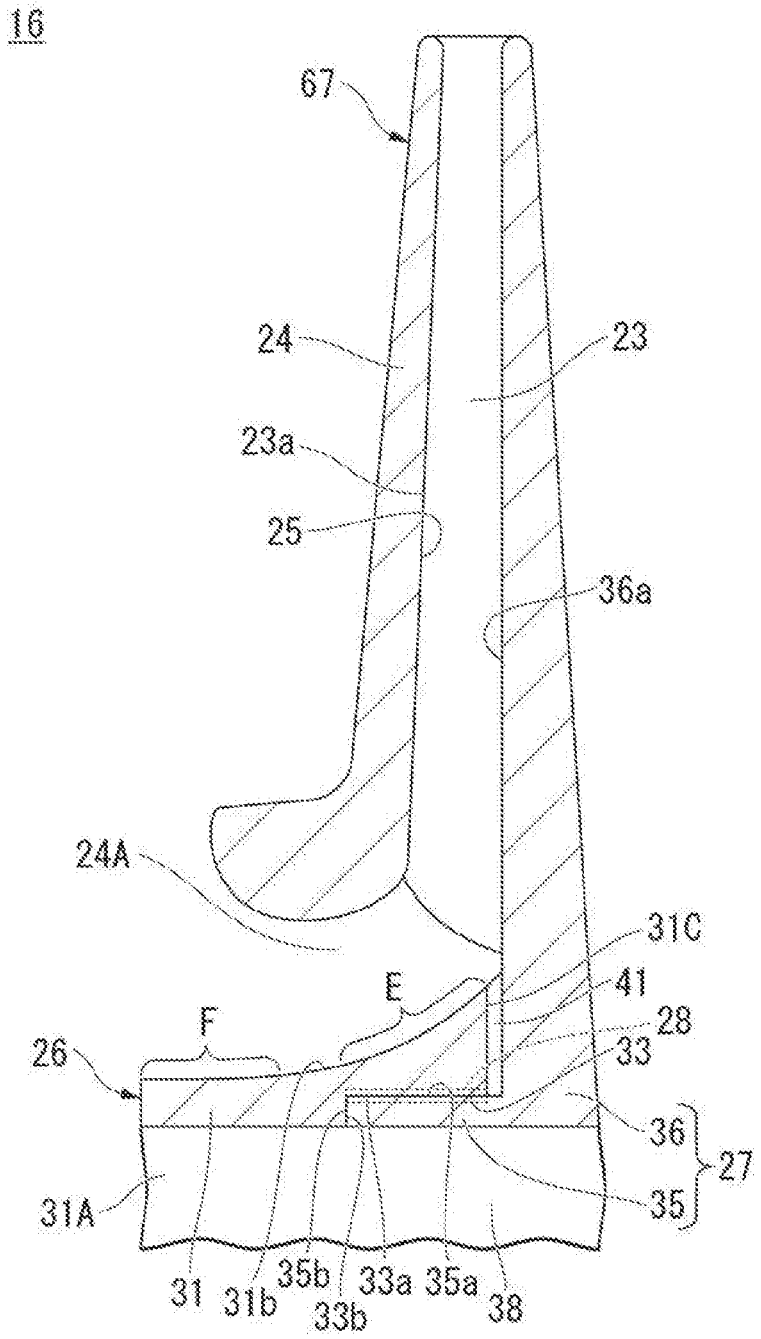
FIG. 8 is a (third) sectional view showing the method for manufacturing an impeller according to the first embodiment of the present invention.

FIGS. 6 to 8 are sectional views showing a method for manufacturing an impeller according to the first embodiment of the present invention. In FIGS. 6 to 8, the same configuration portions as the structures shown in FIGS. 2 to 4 will be assigned with the same reference signs. In FIG. 8, E indicates a region of the outer circumferential surface 31*b* of the first disk main body 31, which is heated at the time of a first shrink-fitting step (hereinafter, referred to as a "region E"). In addition, F shown in FIG. 8 indicates a region of the outer circumferential surface 31*b* of the first disk main body 31, which is heated at the time of a second shrink-fitting step (hereinafter, referred to as a "region F").

With reference to FIGS. 1 to 4, and FIGS. 6 to 8, a method for manufacturing the rotary machine 10 of the first embodiment will be described. While describing the method for manufacturing the rotary machine 10 of the first embodiment, a method for manufacturing the impeller 16 of the first embodiment will be described.

First, in a step shown in FIG. 6, the tubular first disk member 26 having the ring-shaped recessed portion 33 is formed inside through a known technique.

Next, in a step shown in FIG. 7, a structure 67, in which the second disk member 27 having the ring-shaped engaging portion 35 that engages with the first disk member 26 by being inserted into the recessed portion 33, the blades 23 provided on the second disk member 27, and the cover 24 that is provided on the blades and covers the blades 23 are integrated, is formed.

Specifically, the structure 67, in which is the second disk member 27, the blades 23, and the cover 24 are integrated, is formed by processing a base material of the structure 67 with the use of a tool 65 having a rotating processing portion 66.

Since the first disk member 26 shown in FIG. 6 and the second disk member 27 shown in FIG. 7 are separate bodies when forming the structure 67, it is easy to insert the processing portion 66 of the tool 65 between the cover 24 and the second disk member 27. Accordingly, it is possible to easily process the flow passage 25 to be formed between the cover 24 and the second disk member 27. Accordingly, the accuracy of the shape of the flow passage 25 can be enhanced.

In a step of forming the structure 67, for example, the length $L_1$ of the engaging portion 35 may be formed to be larger than the depth $D_1$ of the recessed portion 33. Accordingly, when the engaging portion 35 shown in FIG. 8 is inserted in the recessed portion 33 shown in FIG. 7, the gap 41 shown in FIGS. 2 and 3 can be formed, and thus the occurrence of fretting can be limited.

Next, in a step shown in FIG. 8, the outer circumferential surface 35*a* of the engaging portion 35 is shrink-fitted to the inner circumferential surface 33*a* of the recessed portion 33 by inserting the engaging portion 35 configuring the structure 67 into the recessed portion 33 and heating the first disk main body 31 corresponding to the region E from an outer circumferential surface 31*b* side of the first disk main body 31 at a desired heating temperature (hereinafter, referred to as a "heating temperature $T_1$") (first shrink-fitting step).

At this time, the first shrink-fitting portion 28 is formed in the boundary portion between the outer circumferential surface 35*a* of the engaging portion 35 and the inner circumferential surface 33*a* of the recessed portion 33. Accordingly, the impeller 16 of the first embodiment are manufactured (step of preparing an impeller).

Next, as shown in FIGS. 2 and 3, the rotating body 11 is inserted into the through-holes 31A and 38 of the impellers 16, and the plurality of impellers 16 are disposed at desired positions in the rotating body 11. Next, the portion of the inner circumferential surface 31*a* of the first disk main body 31, in which the recessed portion 33 is not formed, is shrink-fitted to the outer circumferential surface 11*a* of the rotating body 11 by heating the first disk main body 31 corresponding to the region F shown in FIG. 8 (portion where the recessed portion is not formed) from the outer circumferential surface 31*b* side of the first disk main body 31 (second shrink-fitting step).

At this time, the second shrink-fitting portion 18 is formed in the boundary portion between the inner circumferential surface 31*a* of the first disk main body 31 and the outer circumferential surface 11*a* of the rotating body 11. Accordingly, since it becomes not necessary to directly heat the second disk member 27 integrated with the blades 23 by heating the outer circumferential surface 31*b* of the first disk main body 31 corresponding to the region F in a state where the rotating body 11 is inserted in the through-holes 31A and 38 of the impeller 16 as described above, deformation of the blades 23 attributable to the heating can be limited.

For example, a heating temperature $T_2$ when heating the first disk main body 31 in the second shrink-fitting step may be lower than the heating temperature $T_1$ when heating the first disk main body 31 in the first shrink-fitting step.

By making the heating temperature $T_2$ when forming the second shrink-fitting portion 18 which is formed after the first shrink-fitting portion 28 lower than the heating temperature $T_1$ when forming the first shrink-fitting portion 28 as described above, it can be limited that the heating temperature $T_2$ when forming the second shrink-fitting portion 18 has an adverse effect on the first shrink-fitting portion 28 and the strength of bonding between the first disk member 26 and the second disk member 27 decreases.

Next, as shown in FIG. 1, the structures shown in FIG. 2 are accommodated in the casing 19, the rotating body 11 is disposed in the penetrated portion 47, and the rotating body 11 is supported by the journal bearings 13 and the thrust bearing 14. At this time, the flow passages (not shown) provided in the plurality of impellers 16 are connected to the flow passage 51 formed in the casing 19. Accordingly, the rotary machine 10 of the first embodiment is manufactured.

In the method for manufacturing the impeller 16 of the first embodiment, by forming the first disk member 26 and the second disk member 27 as separate bodies, it becomes easy to insert the processing portion 66 of the tool 65, which is used when forming the flow passage 25 to be disposed between the cover 24 and the second disk member 27, into the cover 24 and the second disk member 27. Therefore, the accuracy of the shape of the flow passage 25 can be enhanced.

In addition, by integrally forming the second disk member 27, the blades 23, and the cover 24, work of combining the second disk member 27, the blades 23, and the cover 24 becomes unnecessary. Therefore, a decrease in the accuracy of the shape of the flow passage attributable to assembling work can be limited.

The impeller 55 of the modification example of the first embodiment described above can be manufactured through the same technique as the method for manufacturing the impeller 16 of the first embodiment except that the inner circumferential surface 33*a* and the outer circumferential surface 35*a* are processed to be inclined surfaces.

Second Embodiment

Figure 9:
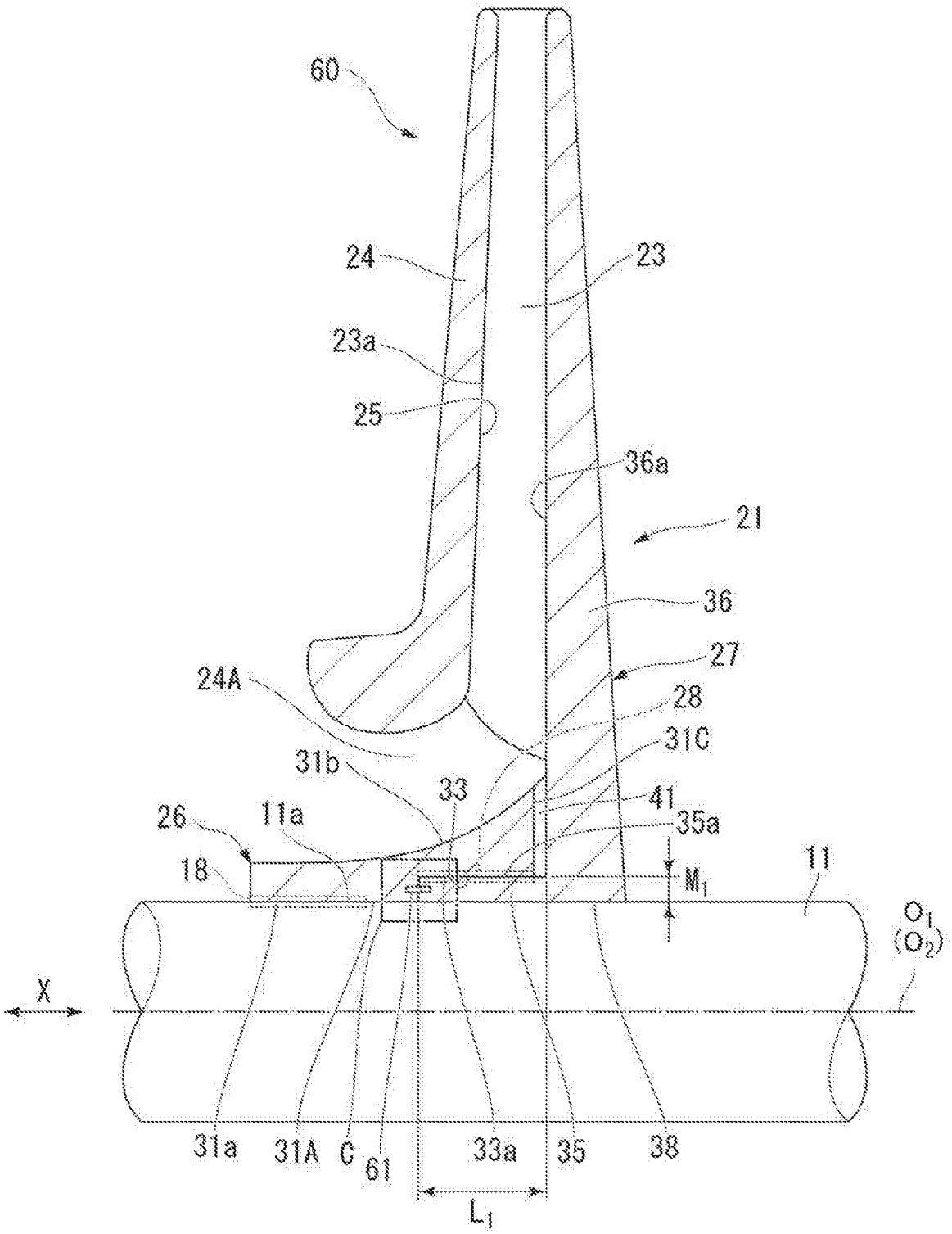
FIG. 9 is a sectional view of an impeller according to a second embodiment of the present invention.

FIG. 9 is a sectional view of an impeller according to a second embodiment of the present invention. FIG. 9 also shows the rotating body 11 which is a configuration element other than an impeller 60. In FIG. 9, the same configuration portions as the structures shown in FIGS. 2 to 4 will be assigned with the same reference signs.

Figure 10:
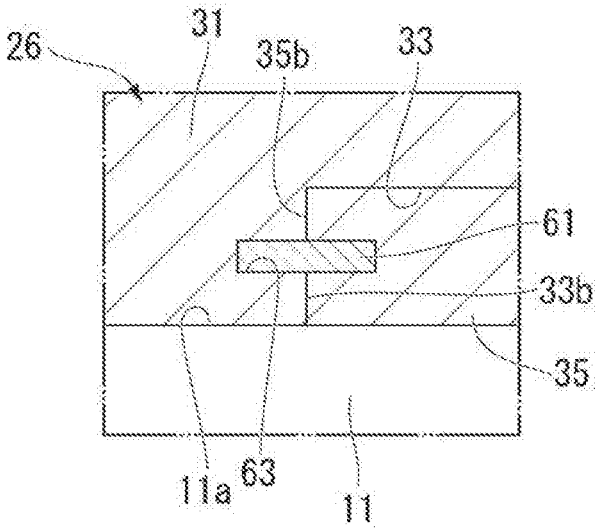
FIG. 10 is a sectional view of an enlarged portion of the impeller shown in FIG. 9, which is surrounded by a region C.

FIG. 10 is a sectional view of an enlarged portion of the impeller shown in FIG. 9, which is surrounded by a region C. In FIG. 10, the same configuration portions as the structures shown in FIGS. 2 to 4 and FIG. 9 will be assigned with the same reference signs.

In FIGS. 9 and 10, the impeller 60 of the second embodiment is configured the same as the impeller 16 except that a positioning key 61 and a key insertion hole 63 are provided in the configuration of the impeller 16 of the first embodiment.

The positioning key 61 is a metal pin. The positioning key 61 is provided in the engaging portion 35 so as to protrude from the tip surface 35*b* in the X-direction.

The key insertion hole 63 is provided in a portion of the first disk main body 31, which opposes the positioning key 61. The key insertion hole 63 is a hole extending in the X-direction. A portion of the positioning key 61, which protrudes from the tip surface 35*b* is inserted in the key insertion hole 63.

By the impeller 60 of the second embodiment having the positioning key 61, which is provided in the engaging portion 35 and protrudes from the tip surface 35*b* in the X-direction, and the key insertion hole 63, which is provided in the first disk main body 31 and into which a part of the positioning key 61 is inserted, positioning between the first disk member 26 and the second disk member 27 (positioning in a rotation direction of which a rotation axis is the central axis $O_1$) can be easily performed.

One or more positioning keys 61 and one or more key insertion holes 63 that are described above may be provided in a circumferential direction of the disk 21.

In the impeller 60 of the second embodiment, the inclined inner circumferential surface 33*a* and the inclined outer circumferential surface 35*a* which are shown in FIG. 5 may be used. In this case, the same effects as the impeller 55 according to the modification example of the first embodiment described above can be obtained.

In addition, the impeller 60 of the second embodiment can be manufactured through the same technique as the method for manufacturing the impeller 16 of the first embodiment described above except that the first shrink-fitting step is performed after the first and second disk members 26 and 27 are formed and then the positioning key 61 is inserted into the key insertion hole 63.

Third Embodiment

Figure 11:
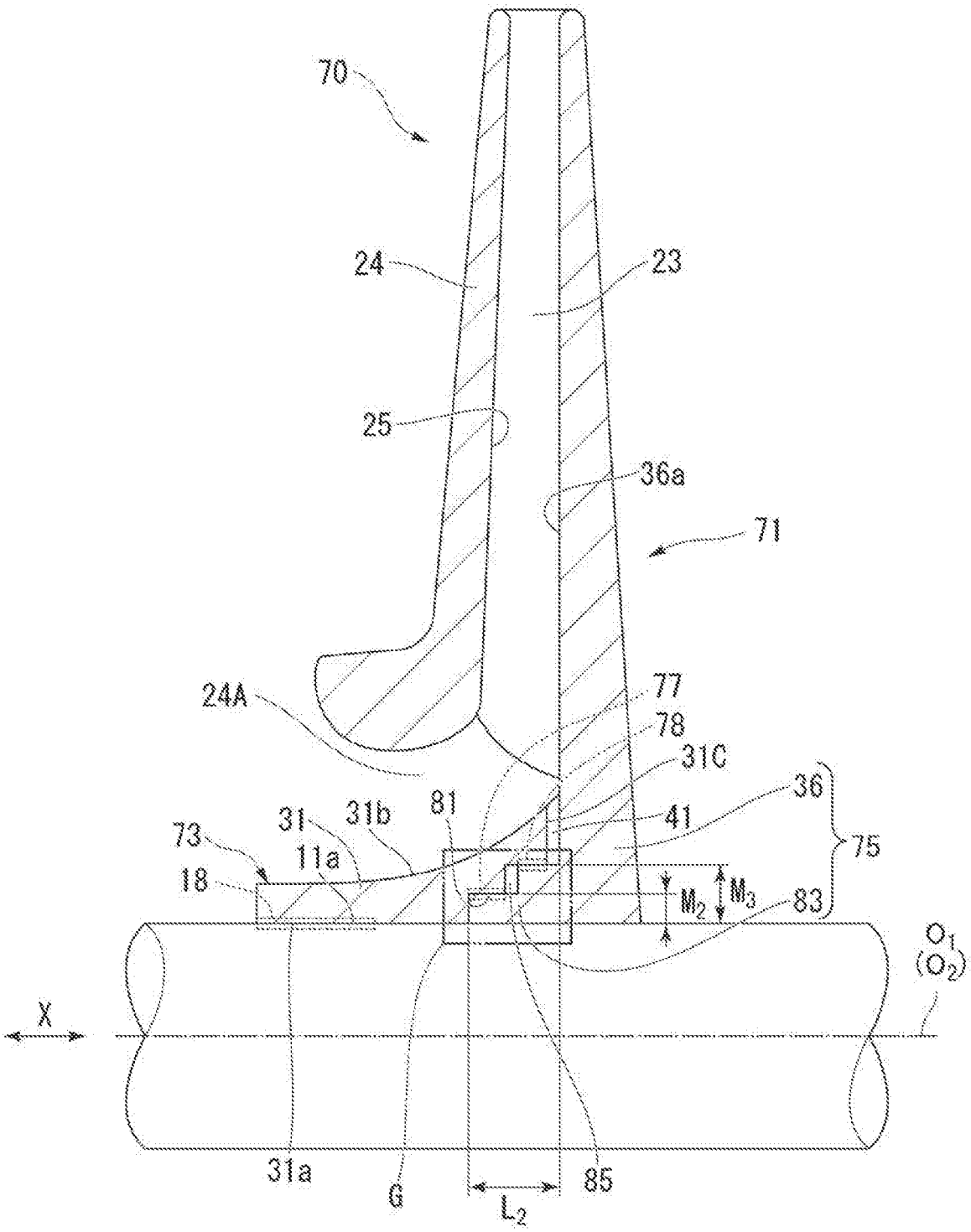
FIG. 11 is a sectional view showing an impeller according to a third embodiment of the present invention.

FIG. 11 is a sectional view showing an impeller according to a third embodiment of the present invention. In FIG. 11, the same configuration portions as the structures shown in FIGS. 2 to 4 will be assigned with the same reference signs. In addition, FIG. 11 schematically shows a state where an impeller 70 is shrink-fitted to the rotating body 11. In FIG. 11, $O_1$ indicates a central axis of a disk 71 (hereinafter, referred to as the "central axis $O_1$").

Figure 12:
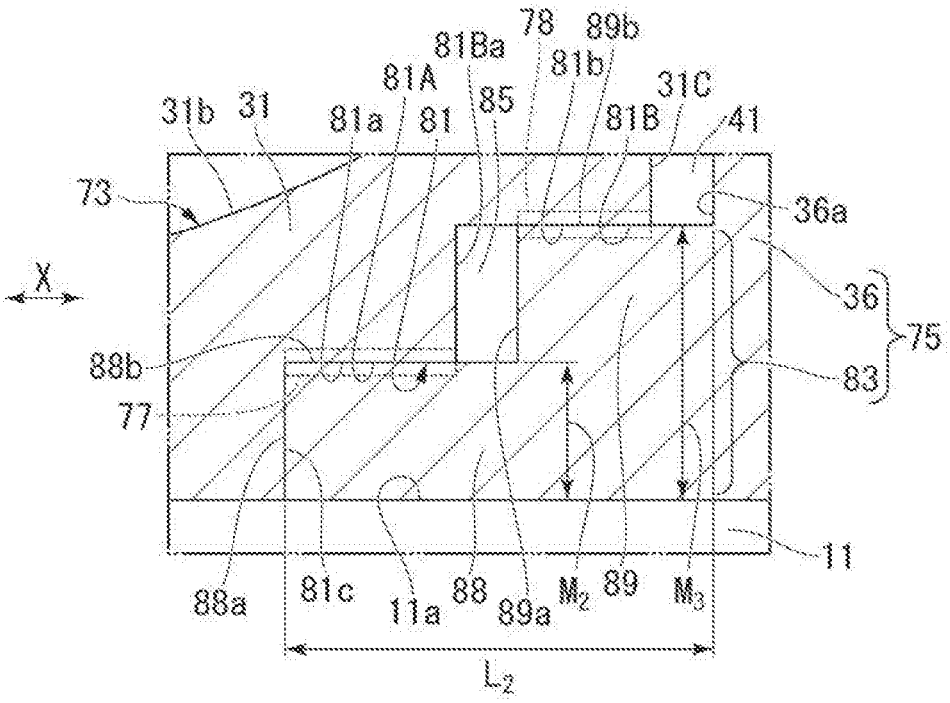
FIG. 12 is a sectional view of an enlarged portion surrounded by a region G, out of structures shown in FIG. 11.

FIG. 12 is a sectional view of an enlarged portion surrounded by a region G, out of structures shown in FIG. 11. In FIG. 12, the same configuration portions as the configurations shown in FIGS. 2 to 4 and FIG. 11 will be assigned with the same reference signs.

In FIGS. 11 and 12, the impeller 70 of the third embodiment is configured the same as the impeller 16 except that the disk 71 is included instead of the disk 21 configuring the impeller 16 of the first embodiment.

The disk 71 has a first disk member 73 and a second disk member 75. The first disk member 73 is configured the same as the first disk member 26 except that a recessed portion 81 having a plurality of steps (for example, two steps in a case of FIGS. 11 and 12) is included instead of the recessed portion 33 configuring the first disk member 26 described in the first embodiment.

The recessed portion 81 includes a first recessed portion 81A and a second recessed portion 81B. The first recessed portion 81A is disposed on a bottom surface 81*c* side of the recessed portion 81. A bottom surface 81*c* functions as a bottom surface of the first recessed portion 81A. The bottom surface 81*c* is a surface orthogonal to the X-direction.

The first recessed portion 81A has an inner circumferential surface 81*a* orthogonal to the bottom surface 81*c*. The first recessed portion 81A is defined by the bottom surface 81*c* and the inner circumferential surface 81*a*.

The second recessed portion 81B is integrally configured with the first recessed portion 81A, and is exposed from the other end 31C of the first disk main body 31. The second recessed portion 81B is a recessed portion having a larger diameter than the first recessed portion 81A.

The second recessed portion 81B has an inner circumferential surface 81*b*, which is larger than an inner diameter of the inner circumferential surface 81*a*, and a bottom surface 81Ba. The bottom surface 81Ba is a surface orthogonal to the X-direction. The bottom surface 81Ba is connected to the inner circumferential surface 81*b*, and is orthogonal to the inner circumferential surface 81*b*.

The first disk member 75 is configured the same as the second disk member 27 except that an engaging portion 83 having a plurality of step portions (for example, two step portions in the case of FIGS. 11 and 12) that can be inserted into the recessed portion 81 is included instead of the engaging portion 35 configuring the second disk member 27 described in the first embodiment.

The engaging portion 83 is a cylindrical member extending in the X-direction, and is inserted into the recessed portion 81. An inner circumferential surface of the engaging portion 83 is in contact with the outer circumferential surface 11*a* of the rotating body 11. The engaging portion 83 has a first step portion 88 and a second step portion 89.

The first step portion 88 is inserted in the first recessed portion 81A. The first step portion 88 has a tip surface 88*a* abutting against the bottom surface 81*c* and an inner circumferential surface 88*b* that comes into contact with the inner circumferential surface 81*a* of the first recessed portion 81A. It is possible to set a thickness $M_2$ of the first step portion 88 to a thickness that is the same as, for example, the thickness $M_1$ of the engaging portion 35 described in the first embodiment.

The second step portion 89 is a tubular member having an outer circumferential portion of which a diameter is larger than the first step portion 88. The second step portion 89 is inserted in the second recessed portion 81B. The thickness $M_2$ of the first step portion 88 is smaller than the thickness $M_3$ of the second step portion 89.

The second step portion 89 has a tip surface 89*a* having a gap 85 interposed between the bottom surface 81Ba of the second recessed portion 81B and the tip surface and an outer circumferential surface 89*b* comes into contact with the inner circumferential surface 81*b* of the second recessed portion 81B. The gap 41 is formed between the other end 31C of the first disk main body 31 and the surface 36*a* of the second disk main body 36.

That is, the engaging portion 83 has the first and second step portions 88 and 89 (the plurality of step portions) having distances from the central axis $O_1$ of the disk 71 to the outer circumferential surfaces 88*b* and 89*b* of the engaging portion 83 in the X-direction, which are different from each other.

By abutting the tip surface 88*a* of the first step portion 88 against the bottom surface 81*c* of the first recessed portion 81A such that the gap 85 is provided between the tip surface 89*a* of the second step portion 89 and the bottom surface 81Ba of the second recessed portion 81B and the gap 41 is provided between the other end 31C of the first disk main body 31 and the surface 36*a* of the second disk main body 36 as described above, the occurrence of fretting (in this case, surface damage that occurs when minute reciprocating slide repeatedly acts between the first disk member 73 and the second disk member 75) can be limited.

In the impeller 70 of the third embodiment, in a case where a width of the inner circumferential surface 88*b* of the first step portion 88 in the X-direction is the same as a width of the outer circumferential surface 89*b* of the second step portion 89 disposed on an outer side of the inner circumferential surface 88*b* in the X-direction, the outer circumferential surface 89*b* disposed on the outer side has a wider area.

Accordingly, for example, in a case where the thickness $M_1$ of the engaging portion 35 having the outer circumferential surface 35*a* shown in FIG. 2 is equal to the thickness $M_2$ of the first step portion 88 and a total area of the outer circumferential surface of the engaging portion 35 and a total area of the outer circumferential surfaces of the engaging portion 83 are obtained as the same area (desired area), it is possible to make the length $L_2$ of the engaging portion 83 having the two inner circumferential surface 88*b* and 89*b* smaller than the length $L_1$ of the engaging portion 35 having the only one outer circumferential surface 35*a*. Thus, the length $L_2$ of the engaging portion 83 in the X-direction can be made small.

It is possible to manufacture the impeller 70 of the third embodiment through the same technique as the method for manufacturing the impeller 16 described in the first embodiment, and the same effects as the method for manufacturing the impeller 16 of the first embodiment can be obtained.

In the impeller 70 of the third embodiment, the inclined inner circumferential surface 33*a* and the inclined outer circumferential surface 35*a* which are shown in FIG. 5 may be used. In this case, the same effects as the impeller 55 according to the modification example of the first embodiment described above can be obtained.

Figure 13:
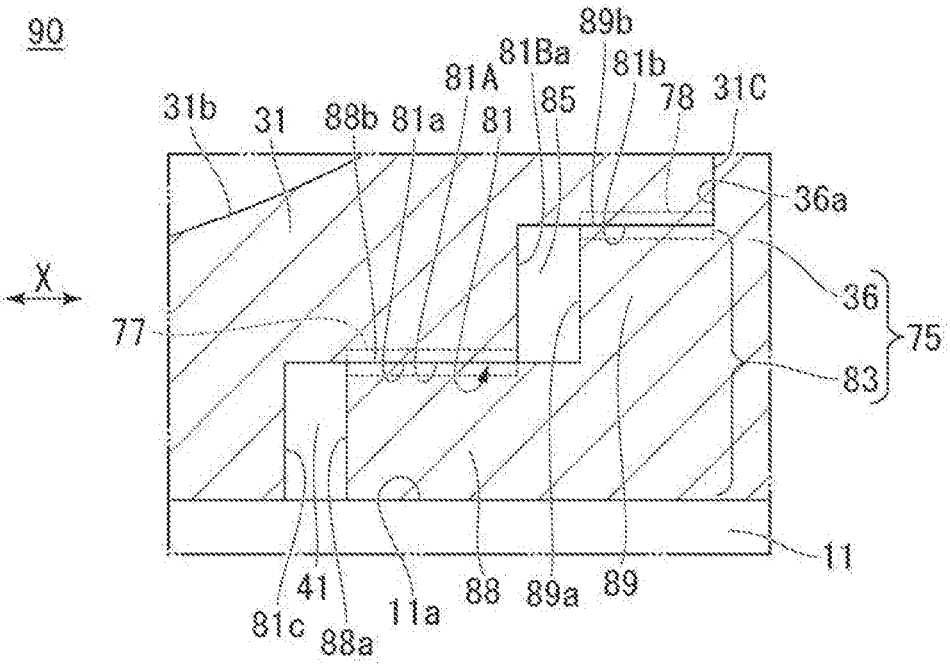
FIG. 13 is a sectional view of enlarged main portions of an impeller according to a modification example of the third embodiment of the present invention.

FIG. 13 is a sectional view of enlarged main portions of an impeller according to a modification example of the third embodiment of the present invention. In FIG. 13, the same configuration portions as the structures shown in FIG. 12 will be assigned with the same reference signs.

In FIG. 13, an impeller 90 according to the modification example of the third embodiment is configured the same as the impeller 70 of the third embodiment except that the gap 41 is disposed between the bottom surface 81*c* and the tip surface 88*a* by abutting the other end 31C of the first disk main body 31 against the surface 36*a* of the second disk main body 36 and separating the bottom surface 81*c* of the recessed portion 81 away from the tip surface 88*a* of the first step portion 88 in the X-direction.

The impeller 90 according to the modification example of the third embodiment which is configured as described above can obtain the same effects as the impeller 70 of the third embodiment described above.

In a case where the engaging portion 83 has the plurality of (for example, two in a case of FIG. 13) step portions as described above, the occurrence of fretting can be limited insofar as a configuration where one of the plurality of step portions and the second disk main body 36 abuts against the first disk main body 31 in the X-direction such that a gap is interposed between the first disk main body 31 and the rest in the X-direction is adopted.

In the impeller 90 of the modification example of the third embodiment, the inclined inner circumferential surface 33*a* and the inclined outer circumferential surface 35*a* which are shown in FIG. 5 may be used. In this case, the same effects as the impeller 55 according to the modification example of the first embodiment described above can be obtained.

In addition, the first disk members 26 and 73 and the rotating body 11 may be integrally configured in the first to third embodiments.

It is possible to manufacture the impeller 90 according to the modification example of the third embodiment through the same technique as the method for manufacturing the impeller 16 described in the first embodiment, and the same effects as the method for manufacturing the impeller 16 of the first embodiment can be obtained.

INDUSTRIAL APPLICABILITY

After integrally configuring the second disk member, which is a separate body from the first disk member, the blades, and the cover, the present invention is applicable to an impeller, a rotary machine, a method for manufacturing an impeller, and a method for manufacturing a rotary machine, in which the accuracy of the shape of the flow passage disposed between the second disk member and the cover can be enhanced.

REFERENCE SIGNS LIST

10: rotary machine
11: rotating body
11*a*, 31*b*, 35*a*, 88*b*, 89*b*: outer circumferential surface
13: journal bearing
14: thrust bearing
16, 55, 60, 70, 90: impeller
18: second shrink-fitting portion
19: casing
21, 71: disk
23: blade
23*a*, 36*a*: surface
24: cover
24A, 31A, 38: through-hole
25: flow passage
26, 73: first disk member
27, 75: second disk member
28: first shrink-fitting portion
31: first disk main body
31*a*, 33*a*, 81*a*, 81*b*: inner circumferential surface
31B: one end
31C: the other end
33, 81: recessed portion
33*b*, 81*c*, 81Ba: bottom surface
35, 83: engaging portion
35*b*, 88*a*, 89*a*: tip surface
36: second disk main body
41, 85: gap
46: casing main body
47: penetrated portion
48: suction port
51: flow passage
53: discharge port
61: positioning key
63: key insertion hole
65: tool
66: processing portion
67: structure
81A: first recessed portion
81B: second recessed portion
88: first step portion
89: second step portion
A, B, C, E, F, G: region
F: working fluid
$D_1$: depth
$L_1$, $L_2$: length
$M_1$, $M_2$, $M_3$: thickness
$O_1$: central axis
$O_2$: axis
$T_1$, $T_2$: heating temperature
$W_1$: width

What is claimed is:

1. An impeller comprising:

a disk that has tubular first and second disk members;

a blade that is integrally provided with the second disk member; and a cover that is integrally provided with the blade and defines a flow passage between the second disk member and the cover, wherein the first disk member defines a part of the flow passage and has a ring-shaped recessed portion that has a central axis direction of the disk as a depth direction thereof, the second disk member has a ring-shaped engaging portion that is configured to engage with the first disk member by being inserted into the recessed portion, a first shrink-fitting portion is provided in a boundary portion between an outer circumferential surface of the engaging portion and an inner circumferential surface of the recessed portion, the inner circumferential surface of the recessed portion coming into contact with the outer circumferential surface of the engaging portion, the second disk member has a portion abutting against the first disk member in the central axis direction of the disk and a portion forming a gap between the first disk member and the second disk member in the central axis direction of the disk, the inner circumferential surface of the recessed portion is inclined in a direction where an inner diameter of the recessed portion becomes narrower from a bottom surface of the recessed portion to a second disk member side of the second disk member, and the outer circumferential surface of the engaging portion is inclined such that a thickness of the engaging portion becomes smaller farther away from a tip surface of the engaging portion, the tip surface being disposed on a first disk member side of the first disk member, in the central axis direction of the disk.

2. A method for manufacturing an impeller, comprising:

a step of forming a tubular first disk member having a ring-shaped recessed portion therein;

a step of forming a structure in which a second disk member having a ring-shaped engaging portion that is configured to engage with the first disk member by being inserted into the recessed portion, and configures a disk with the first disk member, a blade provided on the second disk member, and a cover that is provided on the blade, covers the blade, and defines a flow passage between the second disk member and the cover are integrated; and a first shrink-fitting step of shrink-fitting a boundary portion between an outer circumferential surface of the engaging portion and an inner circumferential surface of the recessed portion by inserting the engaging portion configuring the structure into the recessed portion and heating the first disk member from an outer circumferential surface side of the first disk member, wherein in the step of forming the structure, a length of the engaging portion in a central axis direction of the disk is made larger than a depth of the recessed portion in the central axis direction of the disk such that a portion where the first disk member abuts against the second disk member is formed and a gap is formed between the first disk member and the second disk member, in the step of forming the tubular first disk member, the inner circumferential surface of the recessed portion is inclined in a direction where an inner diameter of the recessed portion becomes narrower from a bottom surface of the recessed portion to a second disk member side of the second disk member, and in the step of forming the structure, the outer circumferential surface of the engaging portion is inclined such that a thickness of the engaging portion becomes smaller farther away from a tip surface of the engaging portion, the tip surface being disposed on a first disk member side of the first disk member, in the central axis direction of the disk.

3. A method for manufacturing a rotary machine, comprising:

a step of preparing an impeller manufactured through a method for manufacturing an impeller, the method for manufacturing the impeller comprising:

a step of forming a tubular first disk member having a ring-shaped recessed portion therein;

a step of forming a structure in which a second disk member having a ring-shaped engaging portion that is configured to engage with the first disk member by being inserted into the recessed portion, a blade provided on the second disk member, and a cover that is provided on the blade, covers the blade, and defines a flow passage between the second disk member and the cover are integrated; and a first shrink-fitting step of shrink-fitting a boundary portion between an outer circumferential surface of the engaging portion and an inner circumferential surface of the recessed portion by inserting the engaging portion configuring the structure into the recessed portion and heating the first disk member from an outer circumferential surface side of the first disk member; and a second shrink-fitting step of shrink-fitting a boundary portion between an inner circumferential surface of a portion of the first disk member, in which the recessed portion is not formed, and an outer circumferential surface of a rotating body by heating the first disk member from an outer circumferential surface side of the portion in which the recessed portion is not formed in a state where the rotating body is inserted in the impeller, wherein in the step of forming the structure, a length of the engaging portion in a central axis direction of the disk is made larger than a depth of the recessed portion in the central axis direction of the disk such that a portion where the first disk member abuts against the second disk member is formed and a gap is formed between the first disk member and the second disk member.

4. The method for manufacturing a rotary machine according to claim 3, wherein a heating temperature of the first disk member in the second shrink-fitting step is lower than a heating temperature of the first disk member in the first shrink-fitting step.

* * * * *